US008844454B2

(12) United States Patent
Brunner et al.

(10) Patent No.: US 8,844,454 B2
(45) Date of Patent: Sep. 30, 2014

(54) ACTIVATION DEVICE FOR A PATH AND TIME DEPENDENT MOTION OF A THREAD CUTTING AND LEAD-IN STITCHING UNIT

(75) Inventors: Severin Brunner, Steckborn (CH); André Stucki, Steckborn (CH)

(73) Assignee: BERNINA International AG, Steckborn (CH)

( * ) Notice: Subject to any disclaimer, the term of this patent is extended or adjusted under 35 U.S.C. 154(b) by 111 days.

(21) Appl. No.: 13/419,546

(22) Filed: Mar. 14, 2012

(65) Prior Publication Data

US 2012/0234221 A1 Sep. 20, 2012

(51) Int. Cl.
*D05B 65/02* (2006.01)
*D05B 65/06* (2006.01)
*D05B 69/02* (2006.01)

(52) U.S. Cl.
CPC ..... *D05B 65/02* (2013.01); *D05B 65/06* (2013.01); *D05B 69/02* (2013.01)
USPC ..... 112/286; 112/293

(58) Field of Classification Search
CPC ..... D05C 11/20; D05B 65/00; D05B 65/003; D05B 65/006; D05B 65/02; D05B 65/04; D05B 65/06
USPC ..... 112/285–301, 274, 197
See application file for complete search history.

(56) References Cited

U.S. PATENT DOCUMENTS

| | | | | |
|---|---|---|---|---|
| 4,365,568 | A * | 12/1982 | Ross | 112/291 |
| 5,370,073 | A * | 12/1994 | Hayashi | 112/291 |
| 6,814,018 | B1 * | 11/2004 | Chuo | 112/292 |
| 7,603,957 | B2 * | 10/2009 | Shiraishi | 112/298 |
| 7,926,434 | B2 * | 4/2011 | Hanada | 112/292 |
| 8,015,934 | B2 * | 9/2011 | Hanada | 112/292 |
| 8,020,502 | B2 * | 9/2011 | Hanada | 112/285 |
| 2013/0055940 | A1 * | 3/2013 | Brunner et al. | 112/292 |

OTHER PUBLICATIONS

U.S. Appl. No. 13/406,855, filed Feb. 28, 2012, "Method for Cutting the Lower and at Least one Upper Thread and a Method for Lead-In Stitching as well as a Device for Implementing the Method".

* cited by examiner

*Primary Examiner* — Danny Worrell
(74) *Attorney, Agent, or Firm* — Volpe and Koenig, P.C.

(57) ABSTRACT

The activation for a path and time related motion of a thread cutting and lead-in stitching unit (7) and the thread brake (25) occurs by a cam drive driven by the primary shaft (9) and a cam drum (75) arranged on the upper shaft (17). This way, an absolute synchronization of the elements of the thread cutting and lead-in stitching unit (7), the thread brake (25), and the hook as well as the needle is ensured.

10 Claims, 14 Drawing Sheets

ACTIVATION DEVICE FOR A PATH AND TIME DEPENDENT MOTION OF A THREAD CUTTING AND LEAD-IN STITCHING UNIT

CROSS-REFERENCE TO RELATED APPLICATIONS

This application claims the benefit of Swiss Patent Application No. 00420/11, filed Mar. 14, 2011, which is incorporated herein by reference as if fully set forth.

BACKGROUND

The invention relates to an activation device for a path and time dependent motion of a thread cutting and stitching unit and the like.

When sewing, and particularly when embroidering with household sewing machines, a frequent ending of a seam and a new start of a seam or an embroidering pattern becomes necessary based on the design pattern. Here, it is important that on the one hand the ending of a seam and the cutting of the thread and the position of the ends of the cut-off threads is performed optimally and that during the start of sewing or embroidering a new stitching the first stitches also occur with a solid knot. One potential method to create this condition is described in the Swiss patent application No. 00339/11. In order to allow performing the processing steps shown here securely with regards to path and time high requirements are set to the actuator elements of the thread cutting and lead-in stitching device. In addition to cutting the thread and lead-in sewing or embroidering, other functions are also switched on in household sewing machines, when applicable, which must include actuator elements driven by the primary shaft with a path and time-dependent progression.

SUMMARY

An objective of the present invention therefore comprises to provide an activation device which is driven by the primary shaft of the sewing machine and thus mandatorily allows a synchronous path and time-dependent progression of the processing steps, adjusted to the functions to be performed.

This objective is attained by an activation device with the features of the invention. Additional advantageous embodiments of the activation device are described below and in the claims.

The activation device according to the invention exhibits a simple design and therefore it can be produced in a cost-effective manner. All functions mandatorily operate synchronously with the primary shaft and thus with the stitch-forming organs of the sewing machine. The trigger of the various motions with regards to point of time and path occurs by a single stroke magnet, with the coupling of the mechanical elements in turn being independent from the precise point of time of activation by the stroke magnet directly via cams circulating synchronously with the stitch-forming elements. Thus, only the correct and predetermined starting point is hereby ensured.

BRIEF DESCRIPTION OF THE DRAWINGS

The invention is explained in greater detail using an illustrated exemplary embodiment for cutting and lead-in stitching. Shown are.

DETAILED DESCRIPTION FOR THE PREFERRED EMBODIMENTS

Figure 1:
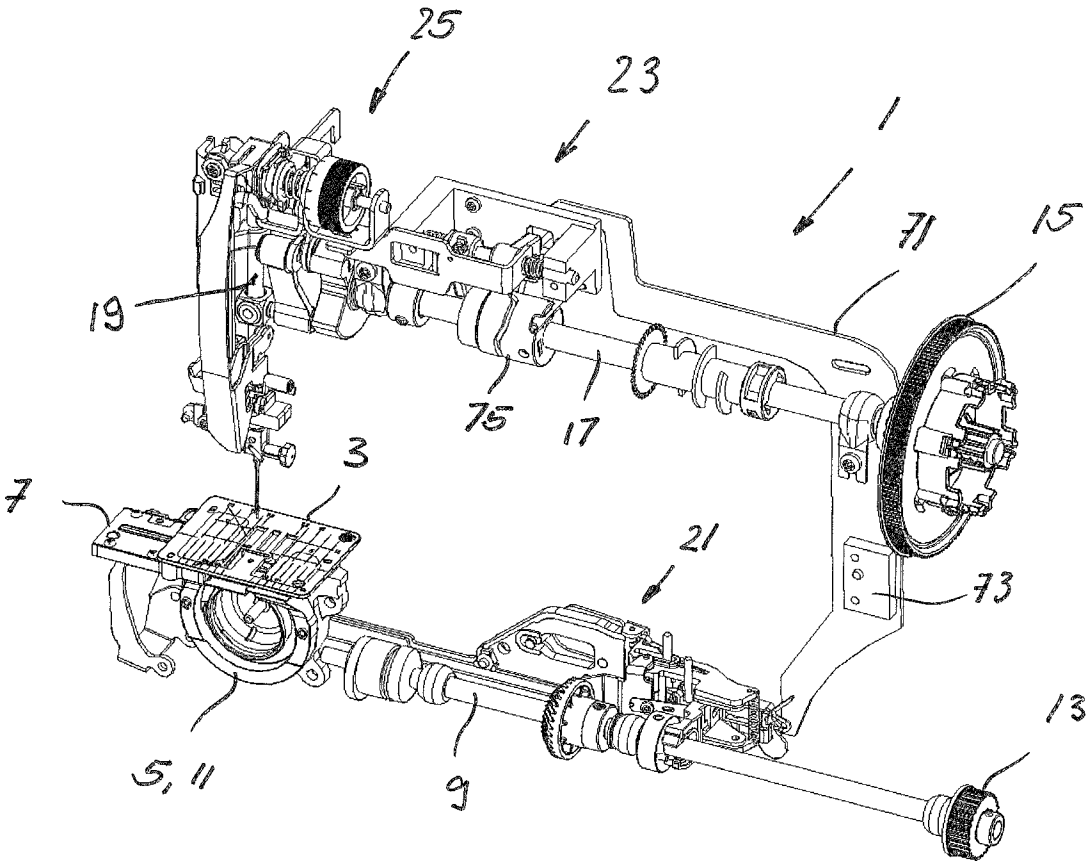
FIG. 1 is a perspective view of the drive elements of a sewing machine in the upper and lower arm (housing omitted)

In the schematic illustration of the drive elements of a sewing machine 1 a stitching plate 3 and underneath thereof a hook receiver 5 are shown without a bobbin case. The rear part of a cutting and stitching unit 7 is discernible at the left in reference to the stitching 3 plate. The primary shaft is marked with the reference character 9, which at its left end is connected to the hook 11 and with at its right end a first belt disk 13 is arranged for transmitting the drive from the primary shaft 9 to a second belt disk 15 on the upper shaft 17. The front end of the upper shaft 17 is effectively connected with the drive for the needle rod 19 and other elements required for creating a seam.

In the following, initially a first actuator element 21 is described for the progression of the motion of the cutting and lead-in stitching unit for the cutting process and subsequently a second actuator element 23 for operating a thread brake 25 to control the tension of the upper thread. The motion progression during lead-in sewing or embroidering occurs similarly, however via a second link.

Figure 2:
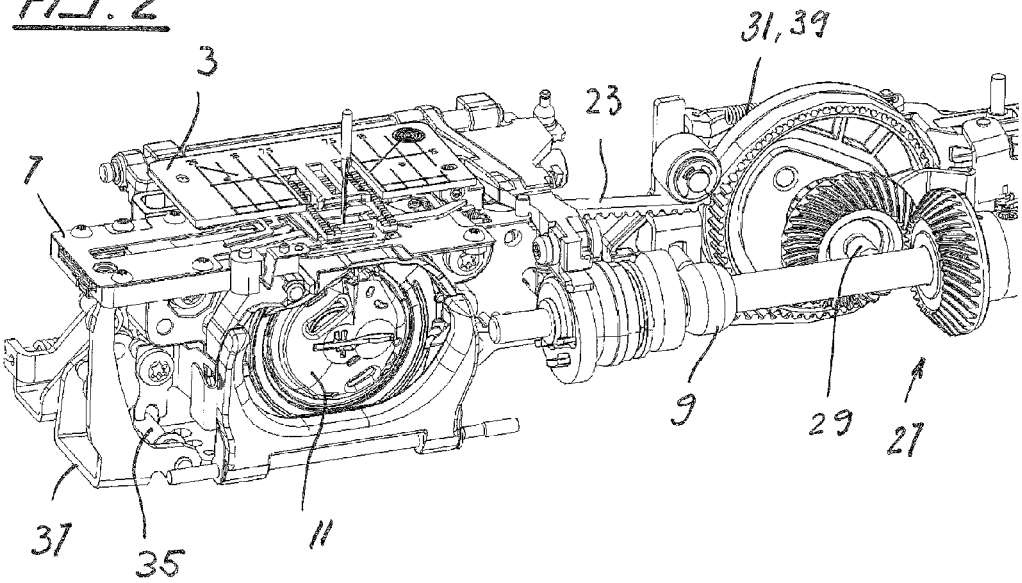
FIG. 2 is an enlarged view of the mechanical elements in the lower arm of the sewing machine.

In an enlarged illustration, FIG. 2 shows the hook 11, the cutting and lead-in stitching unit 7, and the transmission 27 for transmitting the drive from the primary shaft 9 to a gear shaft 29 for a pinion 31, which via a toothed belt 33 drives the hook 11. Further, FIG. 2 shows a lever 37, pivotal about a shaft 35, for a linear displacement of the non-stationary arranged elements of the cutting and lead-in stitching unit 7.

The pinion 31 comprises in its center a disk 39, in which at both facial areas circumferential grooves are inserted forming links. The first groove 41 serves to guide a first pin 45 at an exterior shifting lever 47 for the progression of the motion during cutting. The second groove or link 43 serves to guide a second pin 49 for guiding an interior switching lever 51 for the progression of motion during lead-in stitching. "Exterior" means closer to the housing wall of the bottom arm of the sewing machine, "interior" means located in the center, in the proximity of the primary shaft 9.

Figure 3:
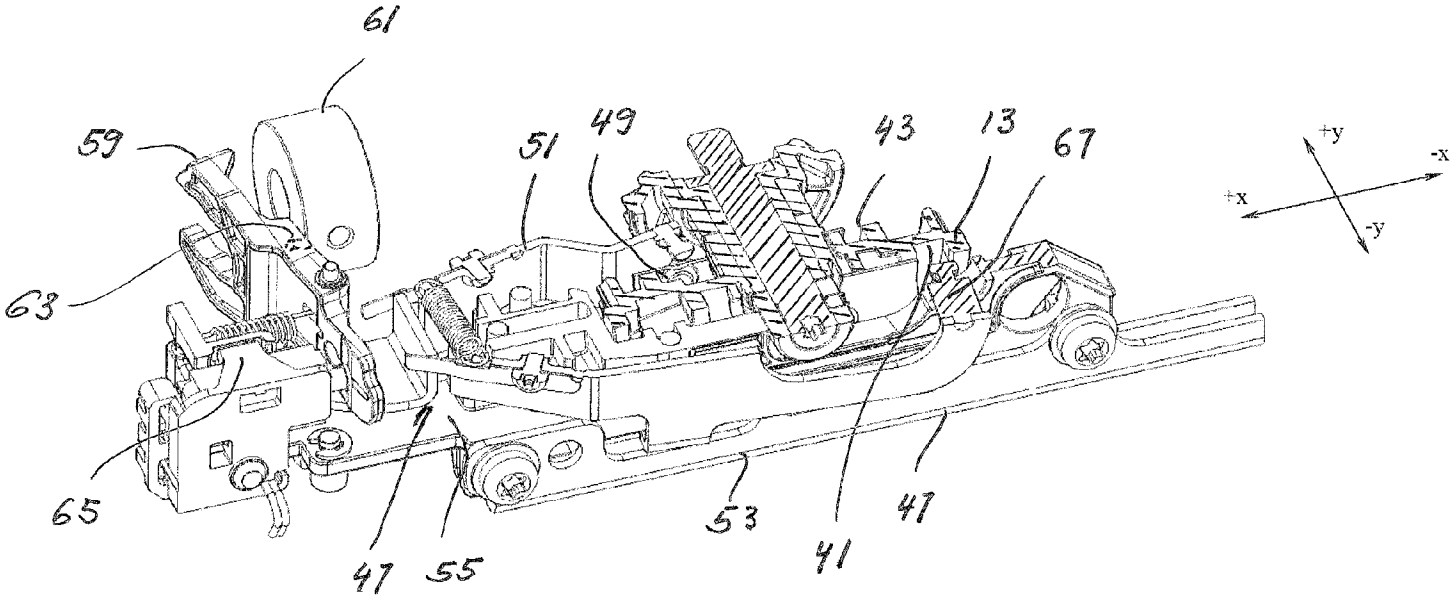
FIG. 3 is a perspective view of the actuator elements at the beginning of the thread cutting process.

In order to perform a cutting process of the threads at the end of a stitching, which occurs by a signal of the operator, e.g., pushing a button, the activation of the thread cutting unit 7 (not shown in greater detail) is triggered at a rotational angle of the upper shaft amounting to 220°. FIG. 3, which contrary to FIGS. 1 and 2 illustrates a view of the pinion 31 for the toothed belt 33 from the rear, shows a coupling sled 55 on a base plate or directly on the frame of the sewing machine and, connected thereto in a fixed manner, a rocker 57. The exterior switching lever 47 and the interior switching lever 51 are linked to the rocker 51 and connected to a coupling lever 59. With its free end the coupling lever 59 contacts an adjusting ring 61, having pins 63 being arranged on its facial areas. The adjusting ring 63 rests on the primary shaft 9 (the primary shaft 9 is not shown in FIG. 3 *ff*) and is driven thereby during sewing or embroidering in a synchronous fashion. Via a magnet 65 the coupling lever 59 can be pivoted about a vertically aligned axis A in order to engage one of the two pins 63 at the adjusting ring 61; in the present example, engaging at an initial angle of 220° for cutting the threads.

Figure 4:
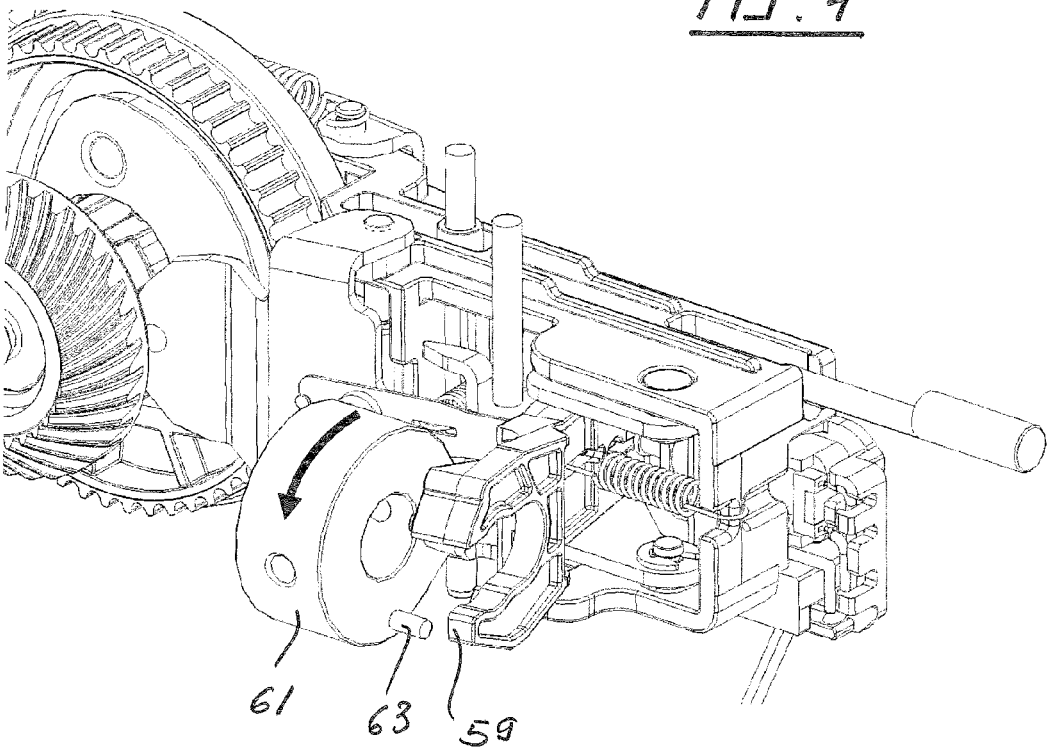
FIGS. 4-11 are perspective views of the actuator elements in different positions during the cutting process.
Figure 5:
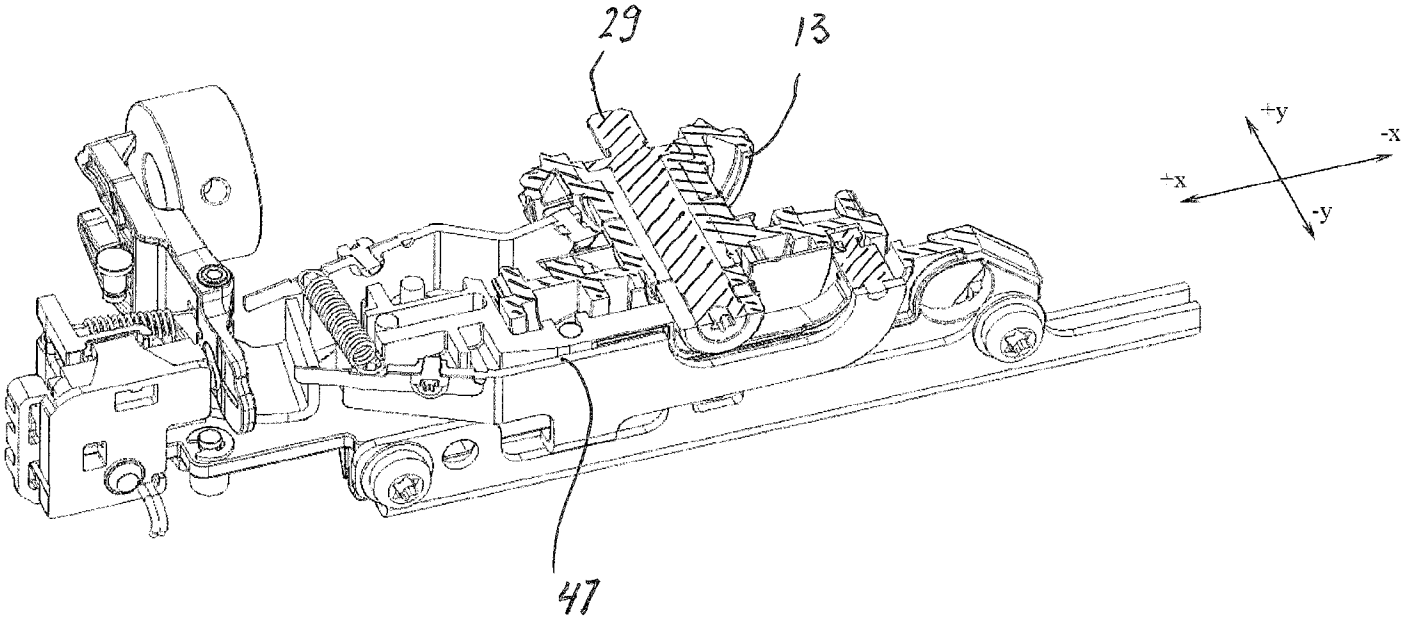
Figure 6:
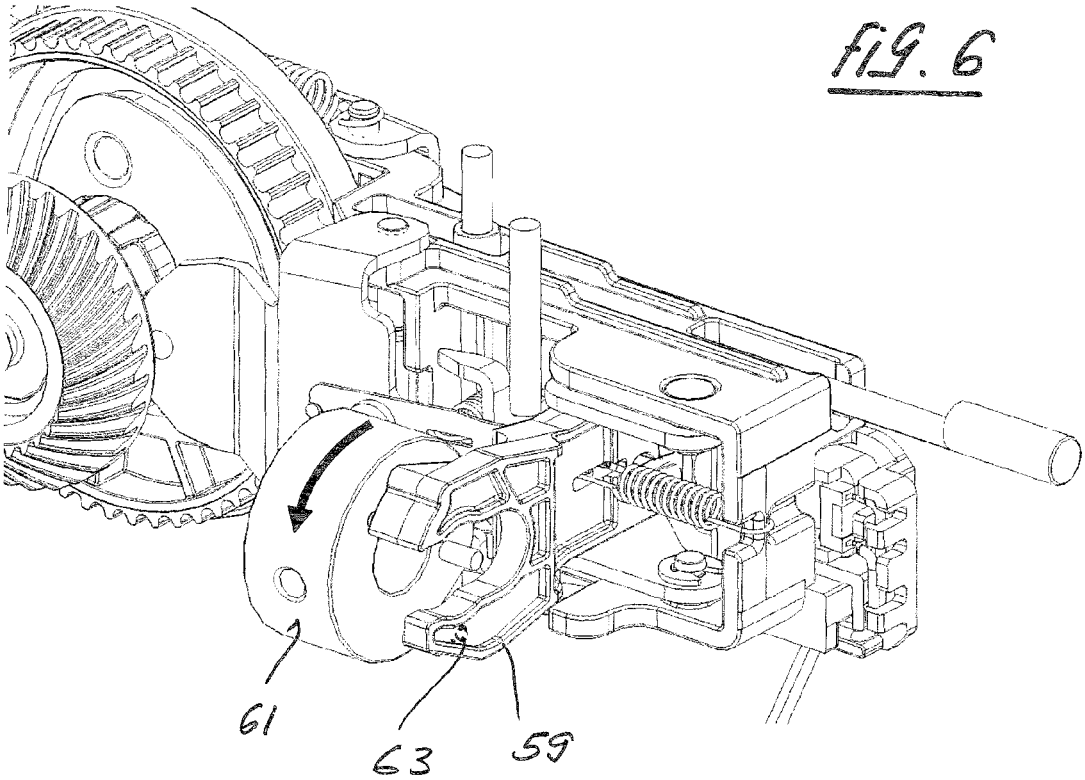
Figure 7:
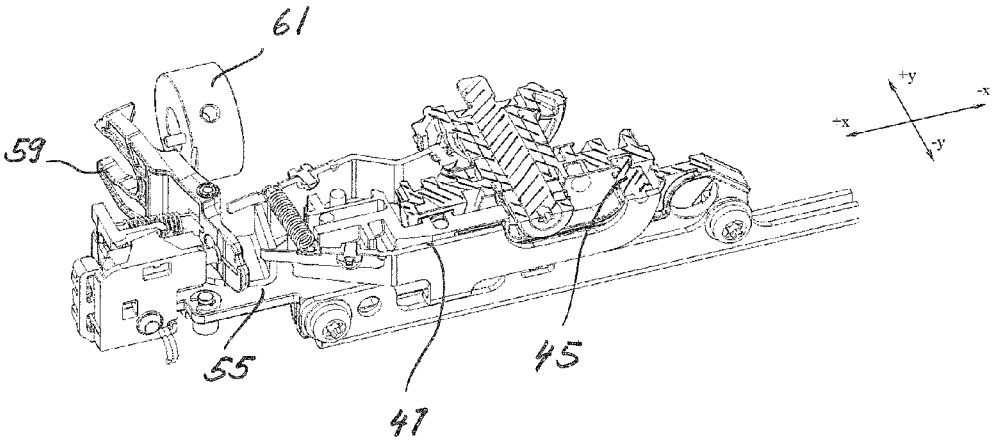
Figure 8:
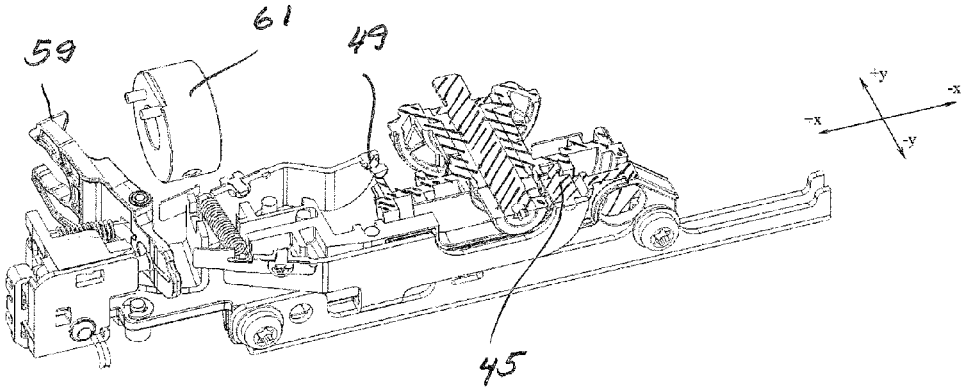

In the following, the triggering of the functions by the activation device is described for the coupling sled 55 and/or the drive of the cutting and lead-in stitching unit 7. After the activation of the magnet 65 the coupling lever 59 pivots clockwise (arrow P+), as shown in FIG. 4, and engages one of the pins 63, namely the pin 63 responsible for the cutting process (FIGS. 5 and 6). This means that the coupling lever 59 pivots the exterior switching lever 47 counter-clockwise by way of the pin 63 pushing the coupling lever 61 towards the rear until the coupling pin 67 engages the groove or link 41 at the free end of the lever 47 at the first belt disk 13. FIGS. 3 through 5 show that after a rotation of the upper shaft by 40° the coupling pin 67 completely engages the link 41. Due to the fact that the link 41 does not describe a concentric circle in reference to the axis of the pinion shaft 29 but rather a curve, which creates the progression of cutting according to a predetermined path and time program, the exterior switching lever 47, which is guided in a horizontal fashion, is guided in the longitudinal direction, here in +x towards the left. Thus, via the coupling sled 55, the cutting unit in FIG. 1 is guided towards the right.

Figure 9:
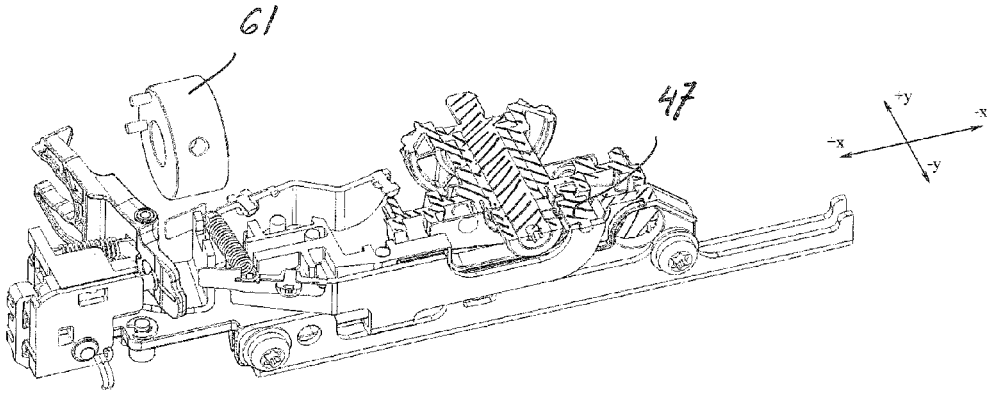
Figure 10:
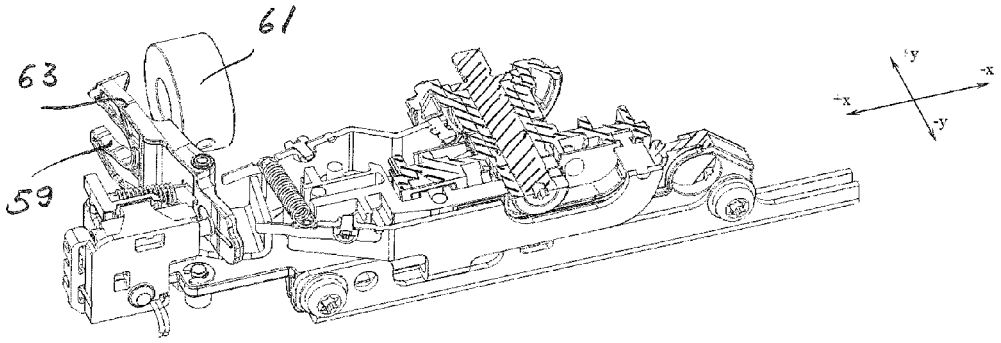
Figure 11:
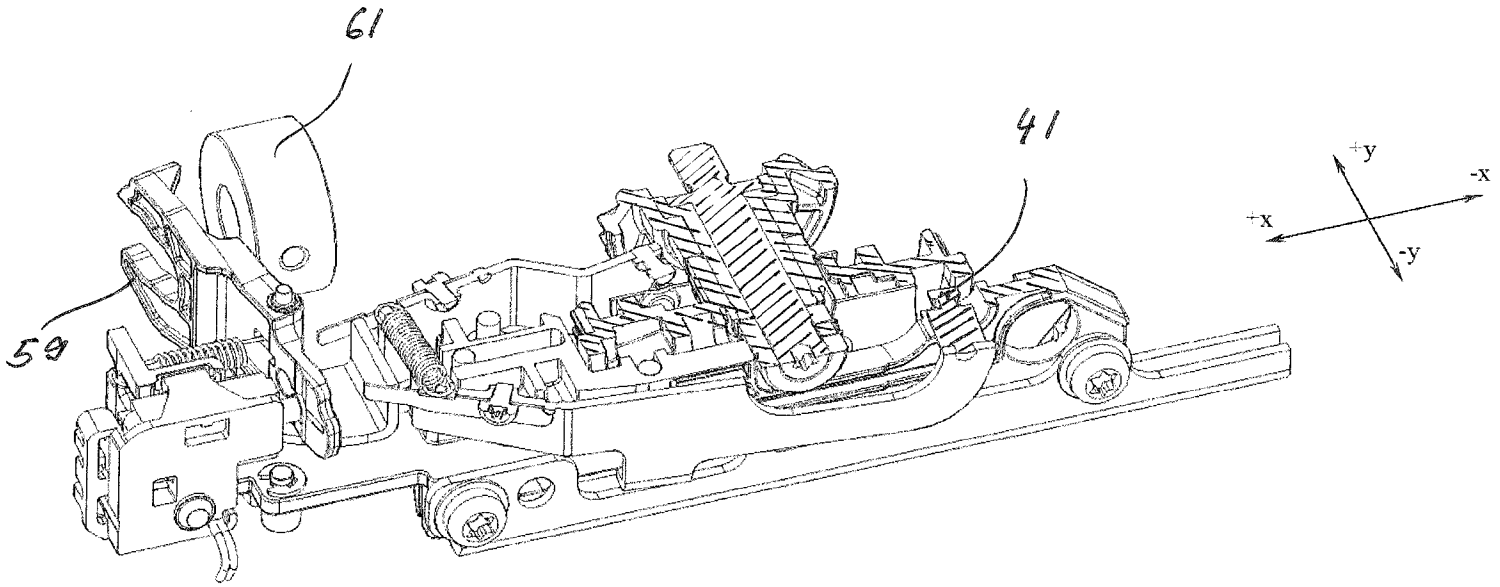
Figure 12:
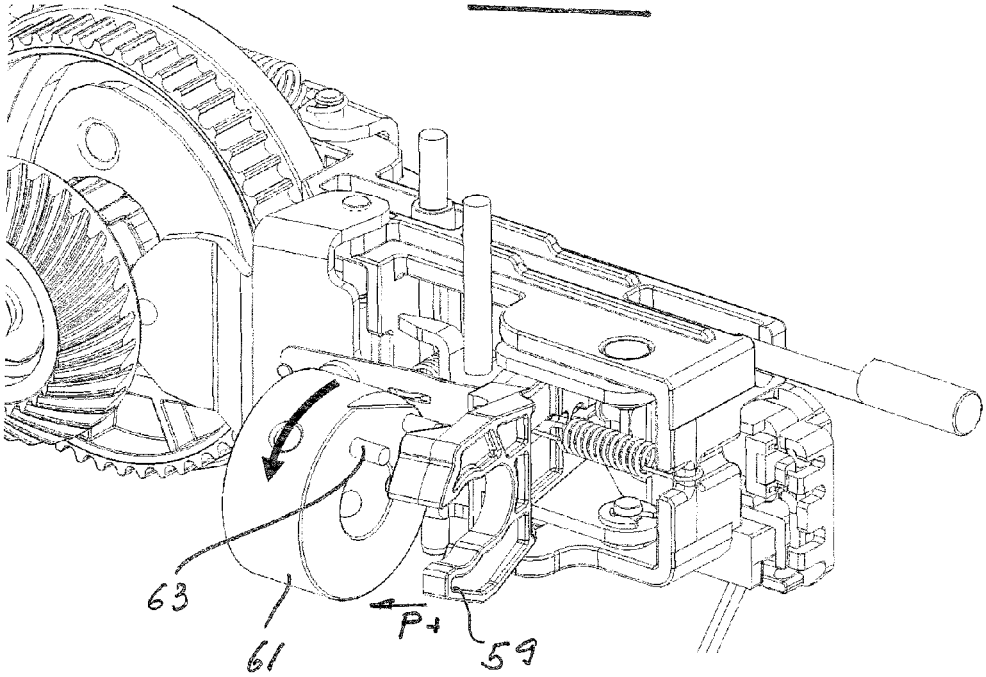
FIG. 12 is an enlarged perspective view of the coupling lever and the adjusting ring prior to coupling.

FIGS. 7 through 10 show the individual displacement sections and the maximum feed occurs in the situation according to FIG. 9. In the range of an angle of the upper shaft of e.g., 0° to 60°, the link 41 shows a constant radius and thus no motion of the coupling sled 55 occurs, here. Shortly before a complete rotation of the primary shaft, at approx. 190°, the coupling lever 59 is again pulled out of the link 41 by the pin 63 at the adjusting ring 61 and then at 215° it already reaches disengagement from the link 41, i.e. 5° prior to a complete rotation. Then the cutting process is concluded.

The drive of the lead-in stitching unit 7 occurs in a similar fashion, however by the coupling of the coupling lever 59 with the second pin 63 of the adjusting ring the coupling lever 59 is moved in a different rotary angular position of the upper shaft such that the interior switching lever 51 moves in the clockwise direction and the coupling pin 69 arranged at its free end engages the second groove or link 43. FIG. 3 shows that the second coupling pin 49 is arranged at a distance from the link 43 and thus remains until the lead-in embroidering process is initiated. Additionally, the length of the interior switching lever 51 is considerably shorter than the one of the exterior switching lever 53 so that the engagement with the link 43, which comprises a different geometrical shape than the exterior link 41, causes an entirely different progression of motion than the one occurring during the cutting of the threads. Thus, the engagement of the second pin 49 in the second groove 43 occurs at a different point of time and/or in a different angular position of the upper shaft 17 than during cutting. This way the threads are guided at the thread cutting and lead-in stitching unit 7 according to a differently progressing path and time schedule than during cutting and the respective function of lead-in stitching can be achieved.

In the enlarged illustrations of the adjusting ring 51 with the pin 63 as well as the coupling lever 49 their mutual position is discernible. The coupling lever 59 has not approached the pins 63, though, and thus no motion of the interior switching lever 51 occurs. At initiation of the sewing or embroidering process the magnet 65 causes the coupling lever 59 to pivot clockwise towards the adjusting ring 61 and the pin 63 located in the image in the front in the rotational direction engages the edge 53. This way the coupling lever 59 is pulled forward in the direction of the arrow V and thus the interior switching lever 51 is pivoted in the clockwise direction and the second pin 49 mounted at the end of the switching lever 51 is inserted into the second groove 43. As soon as this form-fitting connection is created, the interior switching lever 51 is linearly shifted by the progression of the second groove 43, namely according to the path-time diagram predetermined by the form of the link.

Figure 14:
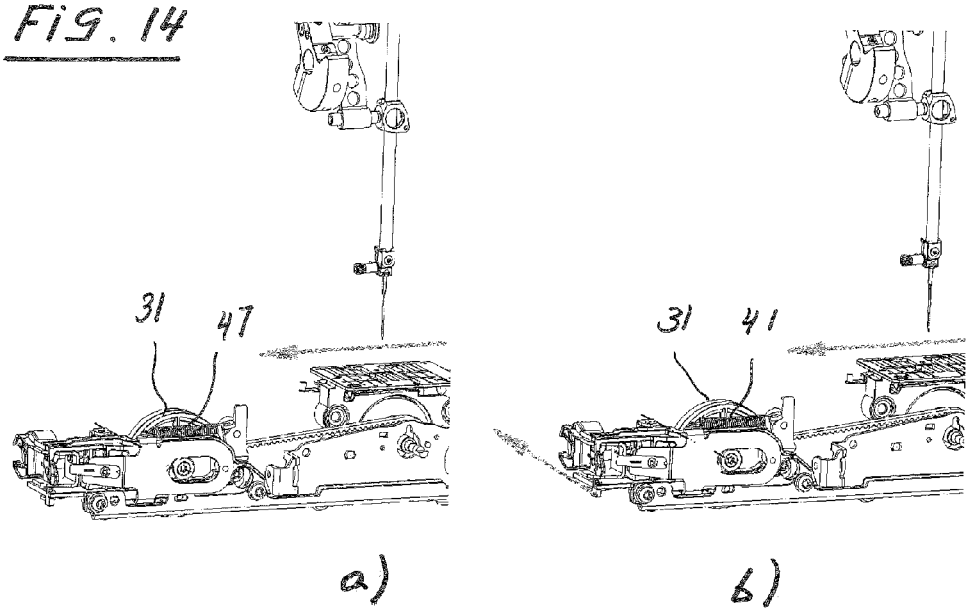
FIG. 14 is a schematic illustration of the actuator elements during the cutting process and during the lead-in stitching process.
Figure 15:
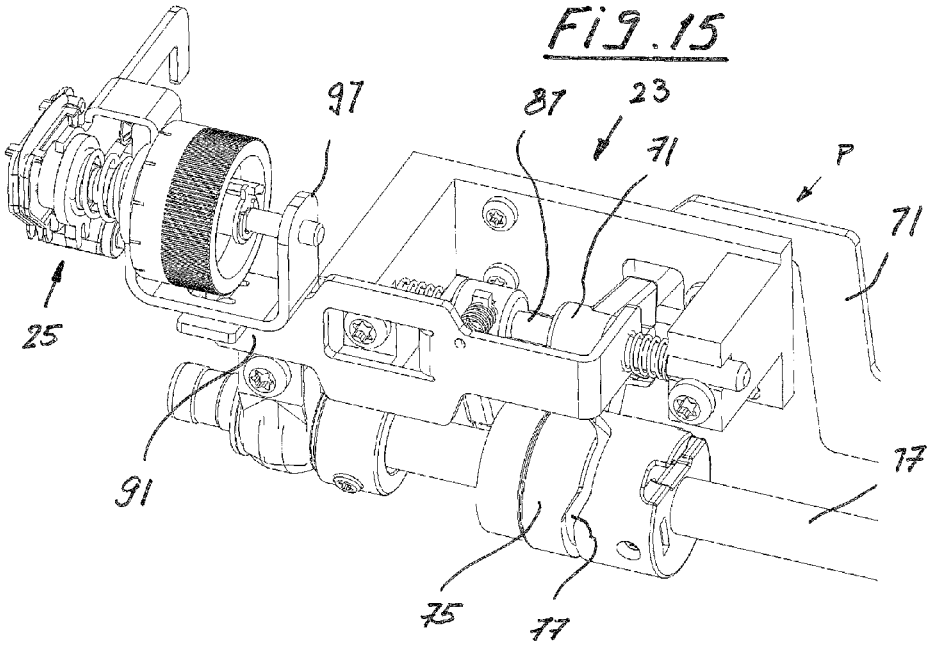
FIG. 15 is a perspective view of the actuator elements for operating the thread brake.
Figure 16:
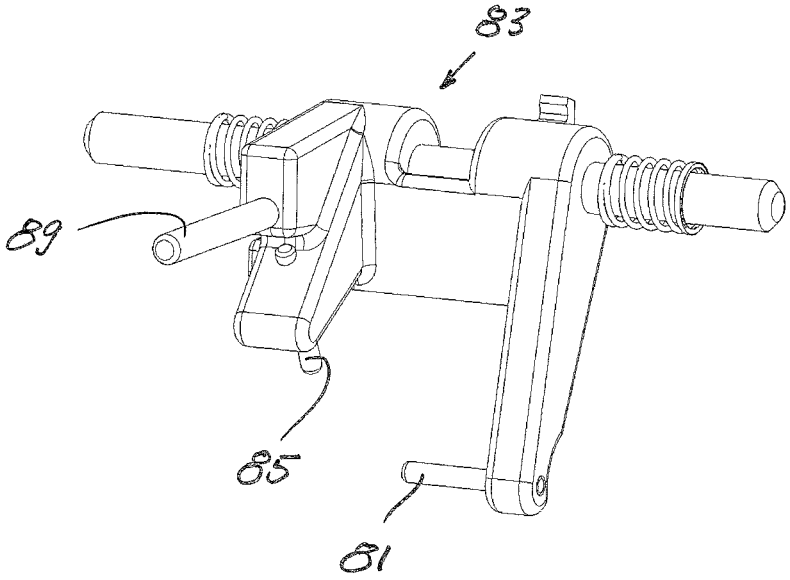
FIG. 16 is a perspective view of the coupling and transmission element for the operation of the thread brake.
Figure 17:
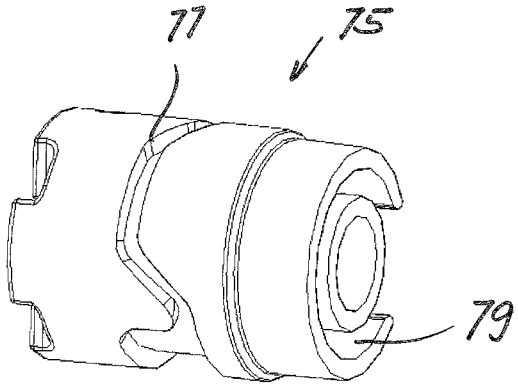
FIG. 17 is a perspective view of a cam disk for triggering the progression of the motion, FIG. 18 *a-c* are views showing three different positions of a safety pin.
Figure 18A:
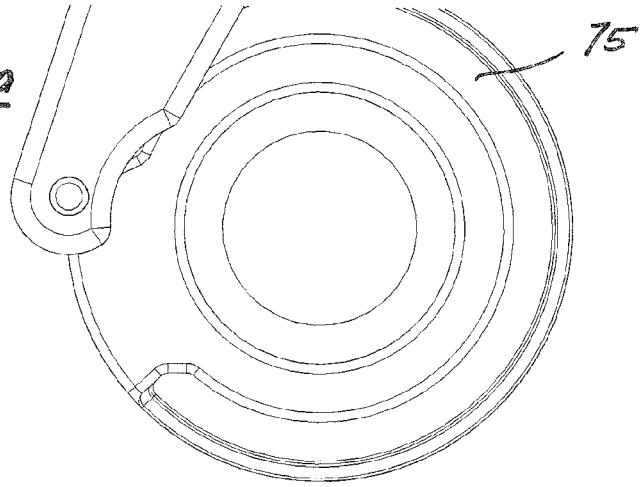
Figure 18B:
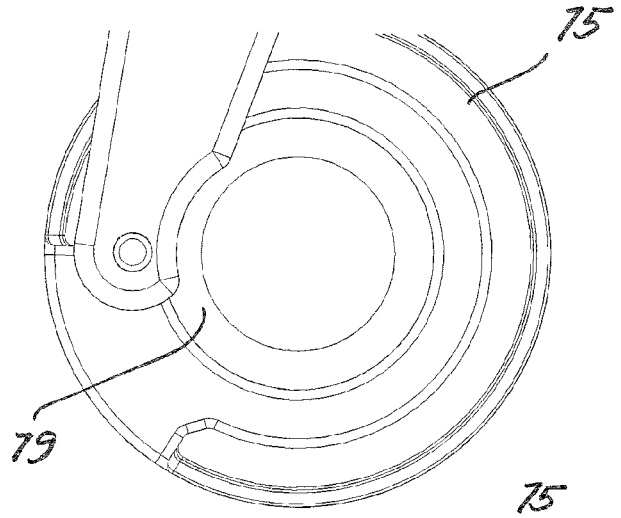
Figure 18C:
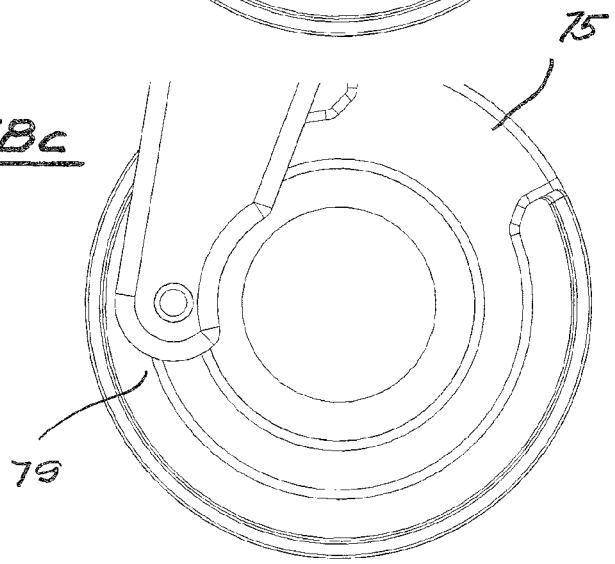

FIG. 14 shows the differences between the cutting process and the stitching process once more in a schematic fashion. For the cutting process described first (right illustration in FIG. 14) it is discernible that the two links 41 and 43 show a different geometric form and consequently lead to two entirely different motion processes, according to which the coupling sled 55 and with it the cutting and lead-in stitching unit 7 are guided.

In order to allow optionally performing the sewing and embroidering process but also the cutting of the threads at the end of a stitching the thread tension of the upper thread must also be adjusted by the thread brake 25 to the respective processing steps during cutting and lead-in stitching.

FIGS. 15 through 19 now describe the functionality and/or the activation of the thread brake 25 based on the respective rotary position of the primary shaft 9 and/or the upper shaft 19. As already discernible in the overview illustration in FIG. 1, the activation of the thread brake 25 occurs by the two-arm lever 71, which is pivotal about a pivotal point 73. One end of the lever 71 is in contact with the coupling sled 47 (cf. FIG. 3), i.e. all motions performed by the coupling sled 55 during the cutting and lead-in stitching process are also transmitted to the lever 71. The other end of the lever 71 engages the actuator elements 23 (cf. FIG. 1), which controls the temporal progression and the amount of the closing force of the thread brake 25. According to FIG. 15, the second actuator element 23 comprises a cam drum 75 with a cam path 77 formed on its periphery. At one of the facial surfaces of the cam drum 75 a partially radially open guide groove 79 can be provided, which guides a holding pin 81 at a pivotal lever 83 such that a guide pin 85, which is pivoted into the cam path 77 of the cam drum 75, securely remains in the cam path 77 until a complete or almost complete rotation of the upper shaft 17 has occurred (cf. FIGS. 17 and 18*a-c*).

Figure 13:
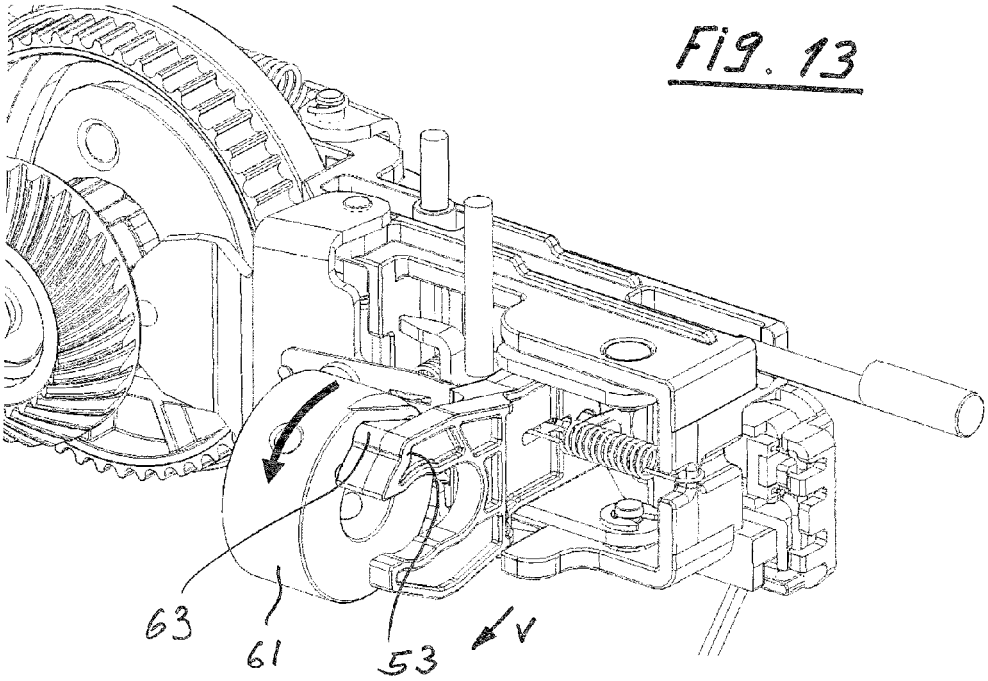
FIG. 13 is an enlarged perspective view of the coupling lever and the adjusting ring after coupling.

The second actuator element 23 operates as follows. By the two-armed lever 71 during the pivoting thereof its end 71*a* moves and the coupling lever 83 is pressed down via a rod 89 and the guide pin 85 is pivoted into the cam path 77. By the constant rotation of the upper shaft 17 and the embodiment of the cam path 77 the pivotal lever 83 first moves in the x-direction. Here, it entrains the opening latch 91 (FIG. 13). By this motion it contacts a fork 93 at the opening latch 91 and entrains it as well. The fork 93 also moves a pressure part 94 by which the thread brake 25 is opened. The duration of said opening of the thread brake 25 is controlled by the cam path 77. Starting at a certain point of time the thread brake 25 must be closed again as fast as possible. This action can be performed with the help of a pressure latch 97. The pressure latch 97 is supported on an extended shaft of the thread brake 25 and articulate in the x-direction as well as the y-direction.

Figure 19:
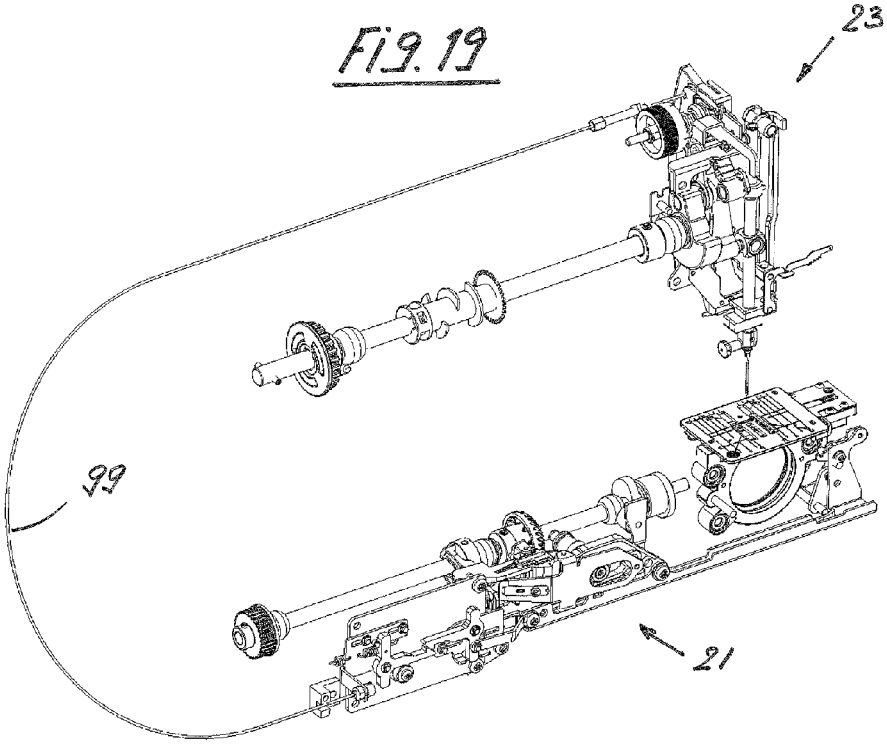
FIG. 19 is a view of another embodiment of the actuator elements for the operation of the thread brake with a throttle release.
Figure 20:
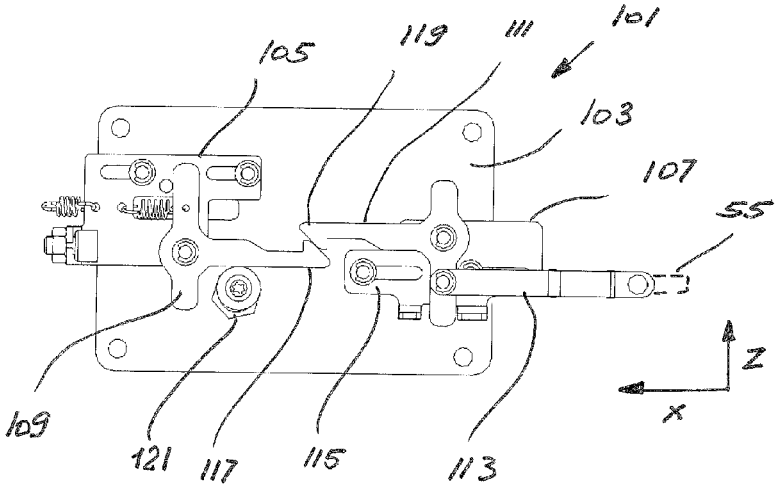
FIG. 20 is a view of the actuator elements for the operation of the thread tension control.

FIG. 19 shows another embodiment of the invention for transmitting the control order from the first actuator element 21 to the second actuator element 23 via a throttle cable 99. The throttle cable 99 is not directly operated by the coupling sled 55 but via a third actuator element 101 (according to FIG. 20). The third actuator element 101 comprises a primary carrier 103, on which the two sleds 105 and 107 are arranged in a linearly displaceable fashion. Each sled 105, 107 carries one link 109 and 111 each, which links 109, 111 each being pivotal about a rotary axis on the sleds 105 and/or 107. The second link 111 is connected with a connecting latch 113 at the coupling sled 55. When the coupling sled 55 is moved in the +x-direction, driven by the first actuator element 21, the second link 111 contacts the stop of a trigger sled 115. As soon as it arrives there it is entrained. As soon as the second coupling sled 107 has traveled the maximally possible stroke the two links 109 and 111 are located behind each other. This means, their hook-shaped ends 117 and 119 engage each other.

Now, when the second coupling sled 107 moves in the opposite direction (−x) the two links 109 and 111 first remain at their position and an idle stroke occurs, namely due to the fact that the trigger sled 115 returns to the initial position. Only at the end of this idle stroke the connection of the two links 109 and 111 acts. Then the first sled 105 reaches a trigger 121. The trigger 121 is embodied as an adjustable eccentric tappet, by which the trigger time can be adjusted. By passing over this trigger point the connecting latch 109 is pivoted and the linked connection is released.

Of course, the claimed activation device can also be used for path and time related methods other than the cutting and lead-in stitching of a sewing machine.

| List of reference characters | |
|---|---|
| 1 | sewing machine |
| 3 | stitching plate |
| 5 | hook receiver |
| 7 | cutting and lead-in stitching unit |
| 9 | primary shaft |
| 11 | hook |
| 13 | first belt disk |
| 15 | second belt disk |
| 17 | upper shaft |
| 19 | needle rod |
| 21 | first actuator element |
| 23 | second actuator element |
| 25 | thread brake |
| 27 | transmission |
| 29 | geared shaft |
| 31 | pinion |
| 33 | toothed belt |
| 35 | shaft |
| 37 | lever |
| 39 | disk |
| 41 | groove |
| 43 | groove |
| 45 | first pin |
| 47 | exterior switching lever |
| 49 | second pin |
| 51 | interior switching lever |
| 53 | edge at 59 |
| 55 | coupling sled |
| 57 | rocker |
| 59 | coupling lever |

-continued

| List of reference characters | |
|---|---|
| 61 | adjusting ring |
| 63 | pin |
| 65 | magnet |
| 67 | coupling pin |
| 69 | coupling pin |
| 71 | two-armed lever |
| 73 | pivot point |
| 75 | cam drum |
| 77 | cam path |
| 79 | guide groove |
| 81 | holding pin |
| 83 | pivot lever |
| 85 | guide pin |
| 87 | shaft |
| 89 | rod |
| 91 | opening latch |
| 93 | fork |
| 95 | pressure part |
| 97 | pressure latch |
| 99 | throttle cable |
| 101 | third actuator element |
| 103 | primary carrier |
| 105 | first sled |
| 107 | second sled |
| 109 | first link |
| 111 | second link |
| 113 | connecting latch |
| 115 | trigger sled |
| 117 | hook-shaped end |
| 119 | hook-shaped end |
| 121 | trigger |

The invention claimed is:

1. A sewing and embroidery machine comprising: an activation device for a path and time related motion of a thread cutting and lead-in stitching unit (7) driven by a primary shaft (9) of the sewing and embroidering machine, a coupling sled (55) that guides a movement of the thread cutting and lead-in stitching unit, a thread brake (25) that controls an upper thread tension, a coupling member that is movable dependent upon a trigger signal, said coupling member inserts one of two switching levers (47, 51) into a respective one of a link (41) for cutting a thread or a link (43) for lead-in stitching, dependent upon a rotational angle of an upper shaft of the sewing and embroidery machine, and thus drives the path and time related motion of the thread cutting and lead-in stitching unit (7) and the thread brake (25) in time with the thread cutting and lead-in stitching unit, and the coupling member (59) is engagable with an adjusting ring (61) on the primary shaft (9) by electrifying a magnet (65).

2. A sewing and embroidery machine comprising: an activation device for a path and time related motion of a thread cutting and lead-in stitching unit (7) driven by a primary shaft (9) of the sewing and embroidering machine, a coupling sled (55) that guides a movement of the thread cutting and lead-in stitching unit, a thread brake (25) that controls an upper thread tension, a coupling member that is movable dependent upon a trigger signal, said coupling member inserts one of two switching levers (47, 51) into a respective one of a link (41) for cutting a thread or a link (43) for lead-in stitching, dependent upon a rotational angle of an upper shaft of the sewing and embroidery machine, and thus drives the path and time related motion of the thread cutting and lead-in stitching unit (7) and the thread brake (25) in time with the thread cutting and lead-in stitching unit, the coupling member (59) is engagable with an adjusting ring (61) on the primary shaft (9) by electrifying a magnet (65), and the coupling lever (59) is connected to a rocker (57) by which the two switching levers (47, 51) are pivoted either with the link (41) for cutting or with the link (43) for lead-in stitching.

3. The activation device according to claim 2, wherein the links (41, 43) are embodied at two faces of a disk (39) driven by the primary shaft (9).

4. The activation device according to claim 3, wherein the disk (39) acts as a drive pinion (31) for a hook (5) of the sewing and embroidery machine.

5. The activation device according to claim 2, wherein the switching levers (47, 51) are supported pivotal about a common axis and that pins (45, 49) are arranged at their free ends for engaging the links (41, 43).

6. The activation device according to claim 2, wherein the thread brake (25) is activated by a third actuator element (101) which is drivable by the coupling sled (55).

7. The activation device according to claim 6, wherein the third actuator element (101) is connected via a lever (71) or a throttle cable (99) to the coupling sled (55).

8. The activation device according to claim 6, wherein the third actuator element (101) comprises a cam drum (75) supported by an upper shaft (17) of the sewing machine or driven thereby, with a guide pin (85) that is pivotable into a cam path (77) of the cam drum via a pivotal lever (83) and the thread brake (25) is operated via a connection member.

9. The activation device according to claim 8, wherein the pivotal lever (83) with the guide pin (85) that is pivotable into the cam path (77) is insertable by the lever (71) of the guide pin (75) into the cam path (77) and is guidable out of the cam path and the thread brake (25) is activated thereby according to a progression of the cam path (77) in the cam drum (75).

10. The activation device according to claim 6, wherein the third actuator element (101) comprises a link arrangement, which is connected to the coupling sled (55) and by which the second actuator element (23) is operated via a throttle cable (99) and by which the thread brake (25) is activated.

* * * * *

UNITED STATES PATENT AND TRADEMARK OFFICE

CERTIFICATE OF CORRECTION

PATENT NO. : 8,844,454 B2
APPLICATION NO. : 13/419546
DATED : September 30, 2014
INVENTOR(S) : Brunner et al.

It is certified that error appears in the above-identified patent and that said Letters Patent is hereby corrected as shown below:

On the Title Page insert:

Item --(30) Foreign Application Priority Data

Swiss Priority Application No. 00420/11, filed March 14, 2011--.

Signed and Sealed this
Third Day of February, 2015

Michelle K. Lee

Michelle K. Lee
*Deputy Director of the United States Patent and Trademark Office*